US009947305B2

(12) United States Patent
Gullbrand et al.

(10) Patent No.: US 9,947,305 B2
(45) Date of Patent: Apr. 17, 2018

(54) BI-DIRECTIONAL MUSIC SYNCHRONIZATION USING HAPTIC DEVICES

(71) Applicant: Intel Corporation, Santa Clara, CA (US)

(72) Inventors: Jessica Gullbrand, Forest Grove, OR (US); Yoshifumi Nishi, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/200,802

(22) Filed: Jul. 1, 2016

(65) Prior Publication Data

US 2018/0005616 A1 Jan. 4, 2018

(51) Int. Cl.

| | |
|---|---|
| ***G10H 3/14*** | (2006.01) |
| ***G10H 1/00*** | (2006.01) |
| ***G10H 1/40*** | (2006.01) |

(52) U.S. Cl.

CPC ..... *G10H 1/0083* (2013.01); *G10H 1/40* (2013.01); *G10H 2210/066* (2013.01); *G10H 2220/081* (2013.01); *G10H 2220/206* (2013.01)

(58) Field of Classification Search

CPC ..... G06F 3/016; G06F 3/017; G06F 1/163; H04L 67/22; G08C 17/02; G08C 2201/32; G08C 17/00; G08C 2201/112; G08C 2201/92; G08C 23/02; A61M 2205/582; A61M 2021/0022; A61M 2230/63; A61M 2202/0007; G10H 2220/311; G09B 15/00

See application file for complete search history.

(56) References Cited

U.S. PATENT DOCUMENTS

| | | | | |
|---|---|---|---|---|
| 6,647,359 | B1 * | 11/2003 | Verplank | G10H 3/12 381/119 |
| 8,378,964 | B2 * | 2/2013 | Ullrich | G06F 3/16 345/156 |
| 2003/0068053 | A1 * | 4/2003 | Chu | G06F 3/016 381/118 |
| 2008/0294984 | A1 * | 11/2008 | Ramsay | G06F 1/1626 715/702 |
| 2009/0153350 | A1 * | 6/2009 | Steger | A63B 71/0686 340/4.2 |
| 2012/0316456 | A1 * | 12/2012 | Rahman | G06F 1/163 600/547 |
| 2012/0326873 | A1 * | 12/2012 | Utter, II | G06F 3/016 340/573.1 |
| 2013/0176142 | A1 * | 7/2013 | Drysdale | G06F 3/011 340/870.02 |
| 2014/0070957 | A1 * | 3/2014 | Longinotti-Buitoni | A61B 5/6804 340/870.01 |

(Continued)

OTHER PUBLICATIONS

Soundbrenner Limited, "Soundbrenner Pulse: Smart Vibrating Metronome", 2016, 18 pages.

*Primary Examiner* — Marlon Fletcher
(74) *Attorney, Agent, or Firm* — Jordan IP Law, LLC

(57) ABSTRACT

Systems and methods may provide for capturing one or more inbound wireless transmissions and identifying a remote user movement based on at least one of the one or more inbound wireless transmissions. Additionally, a local haptic output may be generated, by an actuator, based on the remote user movement. In one example, the actuator is a piezoelectric actuator.

21 Claims, 3 Drawing Sheets

(56) References Cited

U.S. PATENT DOCUMENTS

| | | | | |
|---|---|---|---|---|
| 2014/0184384 | A1* | 7/2014 | Zhu | G09B 21/007 340/4.12 |
| 2014/0210640 | A1* | 7/2014 | Rahman | G06F 9/4401 340/870.16 |
| 2015/0189056 | A1* | 7/2015 | Magi | G06F 1/1652 455/566 |
| 2015/0293590 | A1* | 10/2015 | Lehtiniemi | G06F 3/016 715/702 |
| 2015/0293592 | A1* | 10/2015 | Cheong | G06F 3/016 345/173 |
| 2016/0089751 | A1* | 3/2016 | Batzler | B23K 9/1087 219/125.1 |
| 2016/0139671 | A1* | 5/2016 | Jun | G06F 3/016 715/702 |
| 2016/0205244 | A1* | 7/2016 | Dvortsov | H04M 3/42365 455/413 |
| 2016/0217778 | A1* | 7/2016 | Iermenko | G10H 3/26 |
| 2016/0270717 | A1* | 9/2016 | Luna | G06F 19/3481 |
| 2017/0010670 | A1* | 1/2017 | Tanaka | G06F 1/163 |
| 2017/0038847 | A1* | 2/2017 | Schorsch | G06F 3/017 |
| 2017/0150013 | A1* | 5/2017 | Lacroix | H04N 5/04 |

* cited by examiner

BI-DIRECTIONAL MUSIC SYNCHRONIZATION USING HAPTIC DEVICES

TECHNICAL FIELD

Embodiments generally relate to haptic synchronization. More particularly, embodiments relate to bidirectional music synchronization using haptic devices.

BACKGROUND

Participation in group musical performances such as orchestra and/or band concerts may be challenging, particularly for beginner-to-intermediate level musicians. For example, staying in sync (e.g., on beat) with other jazz and/or rock musicians may be difficult due to the improvisational nature of the performance. Moreover, staying in sync with other musicians in a classical music ensemble may involve the challenging task of simultaneously watching the impromptu movements of a conductor while reading sheet music and playing the instrument.

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Figure 1:
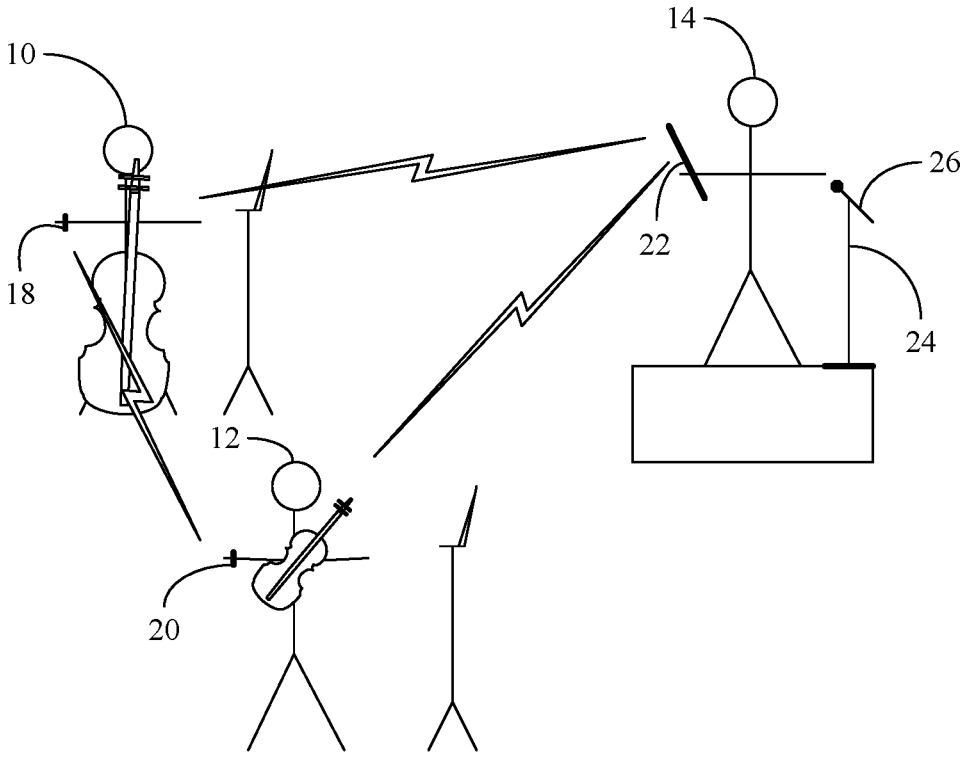
FIG. 1 is an illustration of an example of a haptic synchronization environment according to an embodiment.

Turning now to FIG. 1, a synchronization environment is shown in which a first individual 10, a second individual 12 and a third individual 14 participate in an activity such as, for example, a group musical performance (e.g., an orchestra concert). Synchronization of the physical movements of each of the individuals 10, 12, 14 may generally impact the quality of the performance in terms of tempo, intensity (e.g., loudness/volume), tone, pitch, and so forth. For example, if the first individual 10 is a cellist, the second individual 12 is a violinist, and the third individual 14 is a conductor, synchronization of the cello playing activity (e.g., physical movements) of the first individual 10 with the instructional activity (e.g., physical movements) of the third individual 14 as well as the violin playing activity (e.g., physical movements) of the second individual 12 may result in a more pleasing result from the perspective of a listener.

In order to achieve such synchronization, the illustrated first individual 10 wears a first mobile device 18 (e.g., synchronization-enabled bracelet or other device with a wearable form factor) that is configured to exchange bidirectional wireless transmissions with a second mobile device 20 (e.g., synchronization-enable bracelet or other device with a wearable form factor) worn by the second individual 12 and a third mobile device 22 (e.g., synchronization-enabled baton or other device with a handheld form factor) held by the third individual 14. As will be discussed in greater detail, the mobile devices 18, 20, 22 may deliver haptic outputs (e.g., vibrations) to the individuals 10, 12, 14, respectively, wherein the haptic outputs instruct the individuals 10, 12, 14, when and how to move. For example, a pulse timing of the haptic output delivered by the second mobile device 20 to the skin of the second individual 12 may be structured align in the time domain with the physical movements of the first individual 10 and/or the third individual 14. Accordingly, the second mobile device 20 may enable the second individual 12 to play on tempo with the first individual 10 and/or the third individual 14 even though their movements may be improvisational or impromptu in nature.

Similarly, an intensity of the haptic output delivered by the first mobile device 18 to the skin of the first individual 10 may be structured to have the same intensity of the physical movements of the second individual 12 and/or the third individual 14. In such a case, the first mobile device 18 may enable the first individual 10 to play at the same volume/loudness played by the second individual 12 and/or instructed by the third individual 14.

In yet another example, a waveform shape (e.g., control signal profile) associated with the haptic output delivered by the first mobile device 18 to the skin of the first individual 10 may be structured to mimic the tone (e.g., attack transients, vibrato, envelope modulation and/or other aperiodic aspects) of the physical movements of the second individual 12 and/or the third individual 14. Thus, the first mobile device 18 may enable the first individual 12 to play at the same tone played by the second individual 12 and/or instructed by the third individual 14.

Moreover, a frequency modulation associated with the haptic output delivered by the second mobile device 20 to the skin of the second individual 12 might be structured to indicate the pitch (e.g., note, musical key) of the physical movements of the first individual 10 and/or the third individual 14. In such a case, the second mobile device 20 may enable the second individual 12 play at the same pitch played by the first individual 10 and/or instructed by the third individual 14.

Of particular note is that the bidirectional nature of the illustrated wireless transmissions facilitates a more dynamic synchronization solution. For example, at one moment during the performance, the first individual 10 may take the "lead", wherein the first mobile device 18 assumes a "master" role and provides user movement information to the second mobile device 20, which generates local haptic outputs in accordance with a "slave" role. At another moment during the performance, the second individual 12 may take the lead, wherein the second mobile device 20 assumes the master role and provides user movement information to the first mobile device 18, which generates local haptic outputs in accordance with the slave role. At other moments during the performance, the third individual 14 may take the lead, wherein the third mobile device 22 assumes the master role and provides user movement information to the first mobile device 18 and the second mobile device 20.

Other movement-based aspects of the performance may also be exchanged via the wireless transmissions and haptic outputs. Indeed, other types of activities may benefit from the illustrated solution. For example, other musical performances (e.g., rock concerts), sporting activities (e.g., synchronized swimming, relay races when synchronizing the running steps during handoff), dance recitals, and so forth, may synchronize user movements as described herein. Moreover, different types of mobile devices may be used to track movement and/or generate haptic outputs. For example, the movements of the third individual 14 made while grasping a microphone stand 24, a microphone 26 or other handheld device may be captured and delivered wirelessly to the first mobile device 18 and/or the second mobile device 22 in order to trigger haptic outputs to the first individual 10 and/or the second individual 12, respectively.

Figure 2:
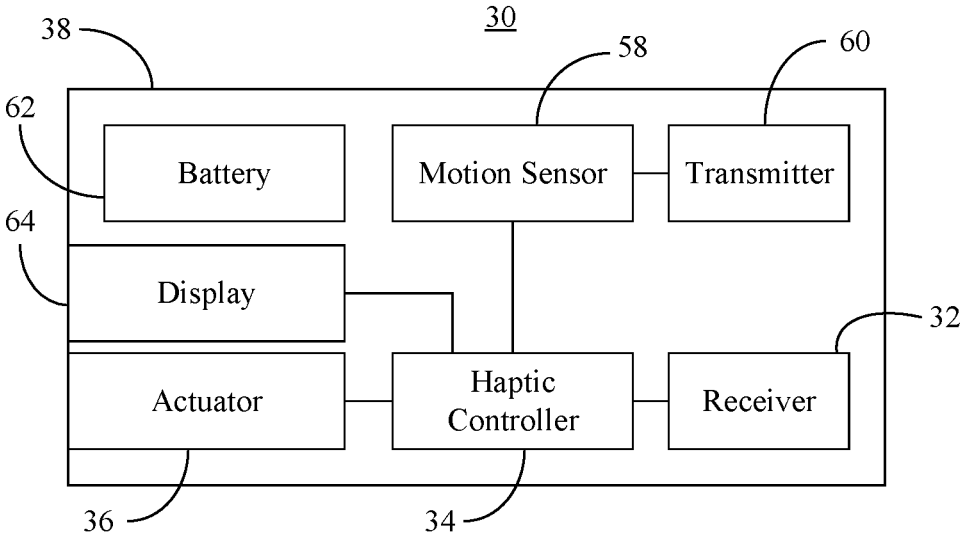
FIG. 2 is a block diagram of an example of a mobile device according to an embodiment.

Turning now to FIG. 2, a mobile device 30 is shown. The mobile device 30 may be readily substituted for and/or incorporated into a synchronization-enabled device such as, for example, the first mobile device 18 (FIG. 1), the second mobile device 20 (FIG. 1), the third mobile device 22 (FIG. 1), the microphone stand 24 (FIG. 1) and/or the microphone 26 (FIG. 1). In the illustrated example, a receiver 32 may capture one or more inbound wireless transmissions (e.g., Bluetooth, Wi-Fi and/or Zigbee transmissions). A haptic controller 34 may be coupled to the receiver 32, wherein the haptic controller 34 identifies remote user movements based on the inbound wireless transmissions.

The remote user movements may be associated with, for example, another musician, conductor, athlete, dancer, and so forth. Thus, in the case of a musician, the user movement might correspond to the back and forth movement of the bow, hand, fingers, wrist or arm of the other musician across the strings of a violin or other stringed instrument, the up and down movement of the sticks, hand or fingers of the other musician over a drum, and so forth. In the case of an athlete, the user movement may correspond to the rhythmic movement of the hand, arm or head of the other athlete in a pool (e.g., during synchronized swimming). Moreover, with respect to a dancer, the user movement may correspond to the rhythmic movement of the various body parts of a dance partner, etc. Other remote user movements may also be identified, depending on the circumstances.

The illustrated mobile device 30 also includes an actuator 36 communicatively coupled to the haptic controller 34, wherein the actuator 36 generates local haptic outputs based on the remote user movements. In one example, the actuator 36 is a piezoelectric actuator. The haptic controller 34 may generally drive the actuator 36 with a control signal that causes the actuator 36 to vibrate in a manner that may be physically felt on an external surface of a housing 38 of the mobile device 30 and/or directly on the actuator 36. Thus, the haptic controller 34 may include compute functionality that enables the haptic controller 34 to determine the context of the remote user movements, an appropriate haptic response and/or parameters of interest to transfer.

Figure 3:
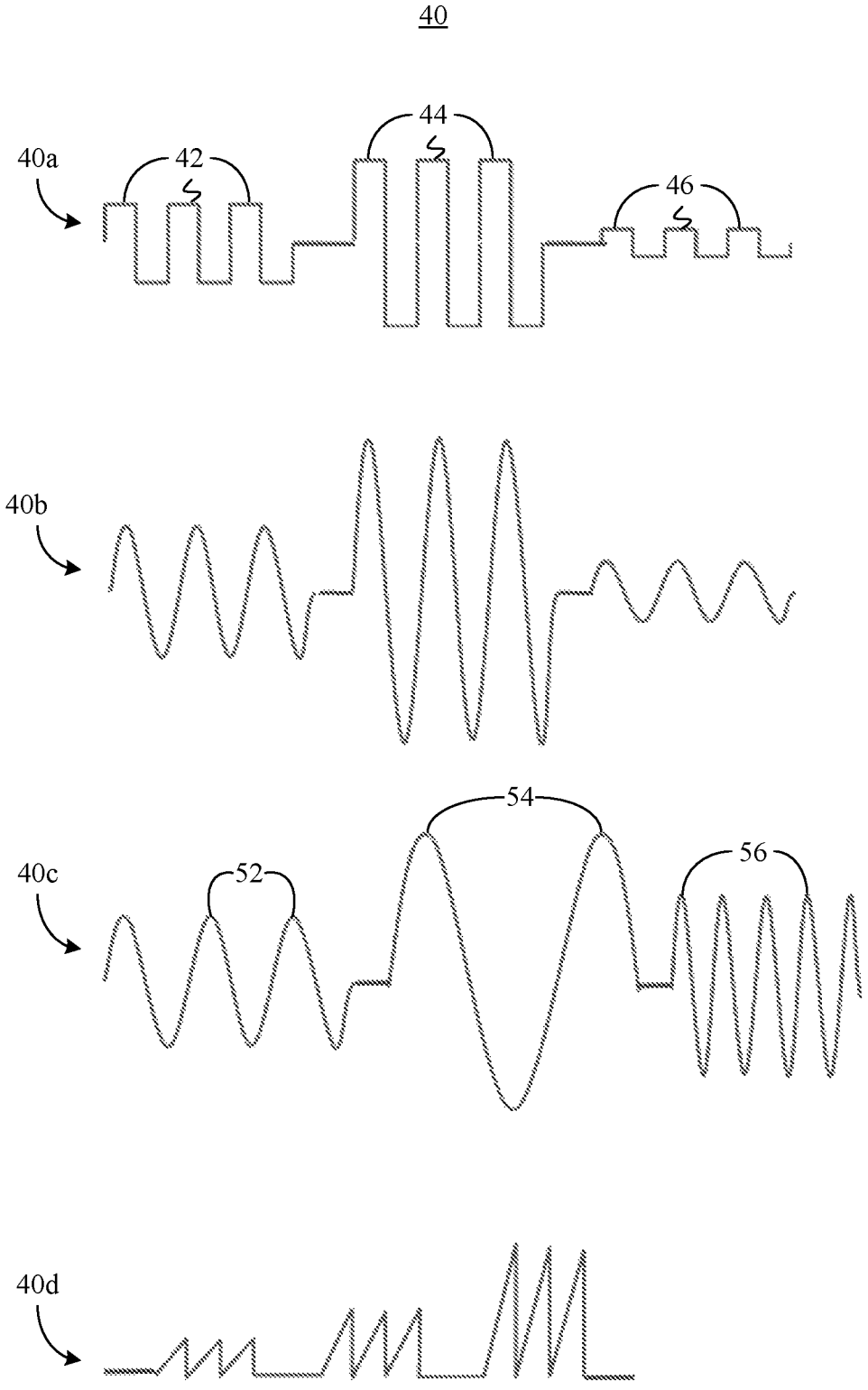
FIG. 3 is an illustration of an example of a set of haptic control signals according to embodiments.

For example, FIG. 3 shows a set of haptic control signals 40 (40*a*-40*d*) that might be used to drive an actuator such as the actuator 36 (FIG. 2). In the illustrated example, a first control signal 40*a* has a square waveform shape. The pulse timing of the square waveform shape may generally indicate the tempo of the remote user movement (e.g., with the rising edge of each pulse representing the remote user reaction to a beat). Moreover, the amplitude of the pulses may indicate the intensity of the remote user movement. For example, a first set of pulses 42 may have an intermediate amplitude to indicate a moderate intensity/volume, a second set of pulses 44 may have a relatively high amplitude to indicate a strong intensity/volume, a third set of pulses 46 may have a relatively low amplitude to indicate a low intensity/volume, and so forth. Additionally, the square waveform shape might indicate a relatively harsh tone (e.g., strong attack).

By contrast, a second control signal 40*b* may have a generally sinusoidal waveform shape. Again, the pulse timing of the sinusoidal waveform shape may indicate the tempo of the remote user movement. Additionally, the amplitude of the pulses may indicate the intensity of the remote user movement. In the illustrated example, the sinusoidal waveform shape may indicate a relatively soft tone (e.g., smooth attack).

A third control signal 40*c* might have a frequency modulated sinusoidal waveform shape. In such a case, the frequency modulation of a given set of pulses may indicate a particular pitch associated with the remote user movement. Thus, a first set of pulses 52 may be modulated at an intermediate frequency to indicate an intermediate pitch (e.g., note, musical key), a second set of pulses 54 may be modulated at a relatively low frequency to indicate a low pitch, a third set of pulses 56 may be modulated at a relatively high frequency to indicate a high pitch, and so forth. Other waveform shapes such as triangle waveforms, sawtooth waveforms, etc., may also be used (or combinations thereof). For example, a fourth control signal 40*d* may have a sawtooth waveform shape that conveys tempo and/or intensity information.

Returning now to FIG. 2, the mobile device 30 may also include a motion sensor 58 (e.g., accelerometer, gyroscope) to detect local user movement. As already noted, the local user movement might correspond to the back and forth movement of the bow, hand, fingers, wrist or arm of a musician across the strings of a violin or other stringed instrument, the up and down movement of the sticks, hand or fingers of a musician over a drum, the rhythmic movement of the hand, arm or head of an athlete in a pool (e.g., during synchronized swimming, relay races when synchronizing the running steps during handoff), the rhythmic movement of the various body parts of a dance partner, etc. Indeed, the motion sensor 58 may detect particular notes being played by virtue of the position of the hand relative to an instrument and/or the vibrations imparted to the hand from the instrument.

Additionally, a transmitter 60 may be communicatively coupled to the motion sensor 58, wherein the transmitter 60 generates one or more outbound wireless transmissions based on the local user movement. Thus, the mobile device 30 may support bidirectional synchronization in which the mobile device 30 may act a slave device or a master device, depending on the circumstances. Moreover, the compute functionality of the haptic controller 34 may enable the haptic controller 34 to determine the context of the local user movements, an appropriate haptic response and/or parameters of interest to transfer. The illustrated mobile device 30 also includes a battery 62 to supply power to the mobile device 30 and a display 64 communicatively coupled to the haptic controller 34. The display 64, which may be omitted from the device 30 depending on the circumstances, may visually present information related to the haptic synchronization (e.g., current tempo, intensity, tone, pitch, etc.).

Figure 4A:
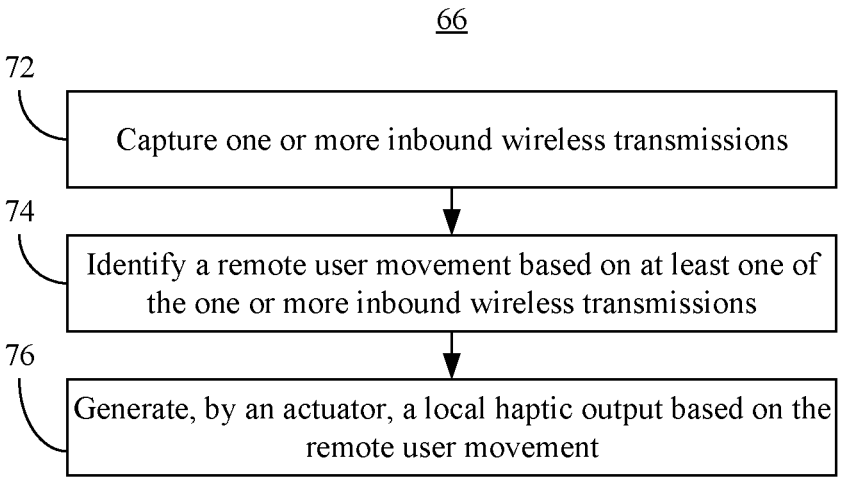
FIGS. 4A and 4B are flowcharts of examples of methods of operating mobile devices according to embodiments.

FIG. 4A shows a method 66 of operating a mobile device in a slave mode. The method 66 may generally be implemented in a device such as, for example, the mobile device 30 (FIG. 2), already discussed. More particularly, the method 66 may be implemented in one or more modules as a set of logic instructions stored in a machine- or computer-readable storage medium such as random access memory (RAM), read only memory (ROM), programmable ROM (PROM), firmware, flash memory, etc., in configurable logic such as, for example, programmable logic arrays (PLAs), field programmable gate arrays (FPGAs), complex programmable logic devices (CPLDs), in fixed-functionality logic hardware using circuit technology such as, for example, application specific integrated circuit (ASIC), complementary metal oxide semiconductor (CMOS) or transistor-transistor logic (TTL) technology, or any combination thereof.

Illustrated processing block 72 provides for capturing one or more inbound wireless transmissions. A remote user movement may be identified at block 74 based on at least one of the inbound wireless transmission(s). Additionally, illustrated block 76 generates, by an actuator, a local haptic output based on the remote user movement. As already noted, a pulse timing of the local haptic output may indicate a tempo of the remote user movement, an intensity of the local haptic output may indicate an intensity of the remote user movement, a waveform shape associated with the local haptic output may indicate a tone of the remote user movement, a frequency modulation associate with the local haptic output may indicate a pitch associated with the remote user movement, etc., or any combination thereof. Moreover, the local haptic output may be generated via a piezoelectric actuator and/or a housing that includes a wearable form factor.

Figure 4B:
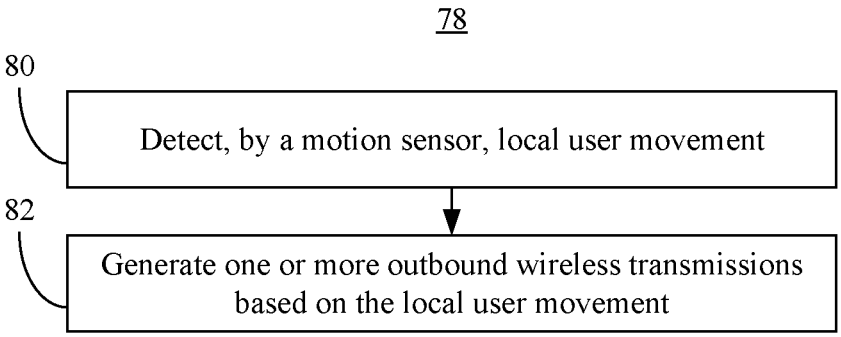

FIG. 4B shows a method 78 of operating a mobile device in a master mode. The method 78 may generally be implemented in a device such as, for example, the mobile device 30 (FIG. 2), already discussed. More particularly, the method 78 may be implemented in one or more modules as a set of logic instructions stored in a machine- or computer-readable storage medium such as RAM, ROM, PROM, firmware, flash memory, etc., in configurable logic such as, for example, PLAs, FPGAs, CPLDs, in fixed-functionality logic hardware using circuit technology such as, for example, ASIC, CMOS or TTL technology, or any combination thereof.

Illustrated processing block 80 may provide for detecting, by a motion sensor, local user movement. The local user movement may be associated with a musician, conductor, dancer, athlete, and so forth. One or more outbound wireless transmissions may be generated at block 82 based on the local user movement.

Additional Notes and Examples

Example 1 may include a synchronization-enabled mobile device comprising a receiver to capture one or more inbound wireless transmissions, a haptic controller communicatively coupled to the receiver, the haptic controller to identify a remote user movement based on at least one of the one or more inbound wireless transmissions, a piezoelectric actuator communicatively coupled to the haptic controller, the piezoelectric actuator to generate a local haptic output based on the remote user movement, wherein a pulse timing of the local haptic output is to indicate a tempo of the remote user movement, a waveform shape associated with the local haptic output is to indicate a tone of the remote user movement, and a frequency modulation associated with the local haptic output is to indicate a pitch associated with the remote user movement, a motion sensor to detect local user movement, and a transmitter communicatively coupled to the motion sensor, the transmitter to generate one or more outbound wireless transmissions based on the local user movement.

Example 2 may include the mobile device of Example 1, further comprising a housing that includes a handheld form factor.

Example 3 may include the mobile device of Example 2, wherein the handheld form factor is selected from a group consisting of a baton form factor, a microphone form factor and a microphone stand form factor.

Example 4 may include the mobile device of any one of Examples 1 to 3, further comprising a housing that includes a wearable form factor, wherein the local haptic output is to be generated via the housing.

Example 5 may include a synchronization-enabled mobile device comprising a receiver to capture one or more inbound wireless transmissions, a haptic controller communicatively coupled to the receiver, the haptic controller to identify a remote user movement based on at least one of the one or more inbound wireless transmissions, and an actuator communicatively coupled to the haptic controller, the actuator to generate a local haptic output based on the remote user movement, a motion sensor to detect local user movement, and a transmitter communicatively coupled to the motion sensor, the transmitter to generate one or more outbound wireless transmissions based on the local user movement.

Example 6 may include the mobile device of Example 5, wherein a pulse timing of the local haptic output is to indicate a tempo of the remote user movement.

Example 7 may include the mobile device of Example 5, wherein an intensity of the local haptic output is to indicate an intensity of the remote user movement.

Example 8 may include the mobile device of Example 5, wherein a waveform shape associated with the local haptic output is to indicate a tone of the remote user movement.

Example 9 may include the mobile device of Example 5, wherein a frequency modulation associated with the local haptic output is to indicate a pitch associated with the remote user movement.

Example 10 may include the mobile device of Example 5, further comprising a housing that includes a handheld form factor.

Example 11 may include the mobile device of Example 11, wherein the handheld form factor is selected from a group consisting of a baton form factor, a microphone form factor and a microphone stand form factor.

Example 12 may include the mobile device of Example 5, further comprising a housing that includes a wearable form factor.

Example 13 may include the mobile device of Example 12, wherein the local haptic output is to be generated via the housing.

Example 14 may include the mobile device of any one of Examples 5 to 13, wherein the actuator includes a piezoelectric actuator.

Example 15 may include a method of operating a synchronization-enabled mobile device, comprising capturing one or more inbound wireless transmissions, identifying a remote user movement based on at least one of the one or more inbound wireless transmissions, and generating, by an actuator, a local haptic output based on the remote user movement.

Example 16 may include the method of Example 15, further including detecting, by a motion sensor, local user movement, and generating one or more outbound wireless transmissions based on the local user movement.

Example 17 may include the method of Example 15, wherein a pulse timing of the local haptic output indicates a tempo of the remote user movement.

Example 18 may include the method of Example 15, wherein an intensity of the local haptic output indicates an intensity of the remote user movement.

Example 19 may include the method of Example 15, wherein a waveform shape associated with the local haptic output indicates a tone of the remote user movement.

Example 20 may include the method of Example 15, wherein a frequency modulation associated with the local haptic output indicates a pitch associated with the remote user movement.

Example 21 may include the method of Example 15, wherein the local haptic output is generated via a housing that includes a wearable form factor.

Example 22 may include the method of any one of Examples 15 to 21, wherein the local haptic output is generated via a piezoelectric actuator.

Example 23 may include a synchronization-enabled mobile device comprising means for capturing one or more inbound wireless transmissions, means for identifying a remote user movement based on at least one of the one or more inbound wireless transmissions, and means for generating, by an actuator, a local haptic output based on the remote user movement.

Example 24 may include the mobile device of Example 23, further including means for detecting, by a motion sensor, local user movement, and means for generating one or more outbound wireless transmissions based on the local user movement.

Example 25 may include the mobile device of Example 23, wherein a pulse timing of the local haptic output is to indicate a tempo of the remote user movement.

Example 26 may include the mobile device of Example 23, wherein an intensity of the local haptic output is to indicate an intensity of the remote user movement.

Example 27 may include the mobile device of Example 23, wherein a waveform shape associated with the local haptic output is to indicate a tone of the remote user movement.

Example 28 may include the mobile device of Example 23, wherein a frequency modulation associated with the local haptic output is to indicate a pitch associated with the remote user movement.

Example 29 may include the mobile device of Example 23, wherein the local haptic output is to be generated via a housing that includes a wearable form factor.

Example 30 may include the mobile device of any one of Examples 23 to 29, wherein the local haptic output is to be generated via a piezoelectric actuator.

Techniques described herein may therefore use networked haptic devices to help novice musicians to stay musically in sync with the rest of the band. Haptic sensations may be modulated to reflect the musical context. For example, pulses may represent beats, vibration amplitude or frequency may represent loudness and/or different wave patterns may represent tones or emotional states. As a results, any need for visual cues (e.g., watching a conductor, reading sheet music) may be obviated, which may in turn enable the musician to focus more attention on the instrument itself. Indeed, learning may be enhanced by the multi-modal sensation provided by the techniques described herein. The techniques described herein may also be incorporated into a wide variety of wearable devices and Internet of Things (IoT) devices.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. A mobile device comprising:

a receiver to capture one or more inbound wireless transmissions;

a haptic controller communicatively coupled to the receiver, the haptic controller to identify a remote user movement based on at least one of the one or more inbound wireless transmissions;

a piezoelectric actuator communicatively coupled to the haptic controller, the piezoelectric actuator to generate a local haptic output based on the remote user movement, wherein a pulse timing of the local haptic output is to indicate a tempo of the remote user movement, an intensity of the local haptic output is to indicate an intensity of the remote user movement, a waveform shape associated with the local haptic output is to indicate a tone of the remote user movement, and a frequency modulation associated with the local haptic output is to indicate a pitch associated with the remote user movement;

a motion sensor to detect local user movement; and a transmitter communicatively coupled to the motion sensor, the transmitter to generate one or more outbound wireless transmissions based on the local user movement.

2. The mobile device of claim 1, further comprising a housing that includes a handheld form factor.

3. The mobile device of claim 2, wherein the handheld form factor is selected from a group consisting of a baton form factor, a microphone form factor and a microphone stand form factor.

4. The mobile device of claim 1, further comprising a housing that includes a wearable form factor, wherein the local haptic output is to be generated via the housing.

5. A mobile device comprising:

a receiver to capture one or more inbound wireless transmissions;

a haptic controller communicatively coupled to the receiver, the haptic controller to identify a remote user movement based on at least one of the one or more inbound wireless transmissions;

an actuator communicatively coupled to the haptic controller, the actuator to generate a local haptic output based on the remote user movement, wherein one or more of an intensity of the local haptic output is to indicate an intensity of the remote user movement, a waveform shape associated with the local haptic output is to indicate a tone of the remote user movement, or a frequency modulation associated with the local haptic output is to indicate a pitch associated with the remote user movement;

a motion sensor to detect local user movement; and a transmitter communicatively coupled to the motion sensor, the transmitter to generate one or more outbound wireless transmissions based on the local user movement.

6. The mobile device of claim 5, wherein a pulse timing of the local haptic output is to indicate a tempo of the remote user movement.

7. The mobile device of claim 5, wherein the intensity of the local haptic output is to indicate the intensity of the remote user movement.

8. The mobile device of claim 5, wherein the waveform shape associated with the local haptic output is to indicate the tone of the remote user movement.

9. The mobile device of claim 5, wherein the frequency modulation associated with the local haptic output is to indicate the pitch associated with the remote user movement.

10. The mobile device of claim 5, further comprising a housing that includes a handheld form factor.

11. The mobile device of claim 10, wherein the handheld form factor is selected from a group consisting of a baton form factor, a microphone form factor and a microphone stand form factor.

12. The mobile device of claim 5, further comprising a housing that includes a wearable form factor.

13. The mobile device of claim 12, wherein the local haptic output is to be generated via the housing.

14. The mobile device of claim 5, wherein the actuator includes a piezoelectric actuator.

15. A method comprising:

capturing one or more inbound wireless transmissions;

identifying a remote user movement based on at least one of the one or more inbound wireless transmissions;

generating, by an actuator, a local haptic output based on the remote user movement, wherein one or more of an intensity of the local haptic output indicates an intensity of the remote user movement, a waveform shape associated with the local haptic output indicates a tone of the remote user movement, or a frequency modulation associated with the local haptic output indicates a pitch associated with the remote user movement;

detecting local user movement via a motion sensor; and generating, with a transmitter, one or more outbound wireless transmissions based on the local user movement, wherein the transmitter is coupled to the motion sensor, wherein the transmitter communicates with the motion sensor.

16. The method of claim 15, wherein a pulse timing of the local haptic output indicates a tempo of the remote user movement.

17. The method of claim 15, wherein the intensity of the local haptic output indicates the intensity of the remote user movement.

18. The method of claim 15, wherein the waveform shape associated with the local haptic output indicates the tone of the remote user movement.

19. The method of claim 15, wherein the frequency modulation associated with the local haptic output indicates the pitch associated with the remote user movement.

20. The method of claim 15, wherein the local haptic output is generated via a housing that includes a wearable form factor.

21. The method of claim 15, wherein the local haptic output is generated via a piezoelectric actuator.

* * * * *